US006971529B1

(12) United States Patent
Shapiro

(10) Patent No.: US 6,971,529 B1
(45) Date of Patent: Dec. 6, 2005

(54) MAGNETIC SHELF UNIT FOR A LOCKER

(75) Inventor: David Shapiro, Chicago, IL (US)

(73) Assignee: It's Academic of Illinois, Inc., Northbrook, IL (US)

( * ) Notice: Subject to any disclaimer, the term of this patent is extended or adjusted under 35 U.S.C. 154(b) by 0 days.

(21) Appl. No.: 10/999,877

(22) Filed: Nov. 30, 2004

(51) Int. Cl.[7] ..... A47B 57/00
(52) U.S. Cl. ..... 211/188; 211/DIG. 1
(58) Field of Search ..... 211/188, DIG. 1, 211/189, 186, 126.12; 248/206.5, 309.4

(56) References Cited

U.S. PATENT DOCUMENTS 4,500,146 A * 2/1985 Peterson ..... 312/257.1
4,818,044 A * 4/1989 Dobry ..... 312/257.1
5,221,013 A * 6/1993 Santucci ..... 211/153
5,251,973 A * 10/1993 Hazan ..... 312/257.1
5,415,472 A * 5/1995 Brise ..... 312/257.1
5,421,646 A * 6/1995 McNamara et al. ..... 312/205
5,474,192 A * 12/1995 Hartzell ..... 211/90.04

* cited by examiner

*Primary Examiner*—Sarah Purol
(74) *Attorney, Agent, or Firm*—Wood, Phillips, Katz, Clark & Mortimer

(57) ABSTRACT

A shelf unit for a metallic locker including at least one set of legs, and a first shelf lying horizontally in the metallic locker on top of the set of legs. Each leg set includes at least three legs having a foot at their bottom and a head at their top, at least one of the legs being magnetic for attaching to the side wall of the metallic locker. A kit consisting of the components of the shelf unit is also provided.

5 Claims, 4 Drawing Sheets

MAGNETIC SHELF UNIT FOR A LOCKER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward shelf units, and particularly toward shelf units usable in metal lockers.

BACKGROUND OF THE INVENTION AND TECHNICAL PROBLEMS POSED BY THE PRIOR ART

Lockers are widely used in a variety of places, including schools, airports, bus stations, etc. Some uses are relatively transient, short term or infrequent. For example, locker type structures may be used for long or short term storage by individuals, where access to the stored materials is only infrequently had. However, in many cases the lockers are used over a long period of time, with the user making frequent access to the locker. Schools are a common example where lockers are so used, with a student keeping a specific locker for an entire school year and going into their locker to place or retrieve items (e.g., books, coats, boots, etc.) multiple times each school day. Each locker may be used in that manner for decades by scores of different students. Of course, in such facilities where frequent use is expected over a period of years, the lockers are typically made of a suitable strong and durable material such as steel or other hard metals.

While many school lockers will have, for example, a shelf at the top of the locker, many students using such lockers wish to have the ability to organize items in their locker to a greater extent than that single shelf may permit. Therefore, students have heretofore added their own shelf units at the bottom of their lockers. Such shelf units have been, for example, free standing structures which extend across less than the full width of the locker, where the structure is put into the locker fully assembled. Still other shelf units have been used which require assembly within the locker. While those shelf units have the advantage of permitting the shelves to potentially span substantially the full width of the locker (i.e., since the door opening of the locker is typically narrower than the locker interior space, making pre-assembled units difficult to get into the locker), they can be difficult to assemble and can be relatively flimsy even after assembled.

The present invention is directed toward overcoming one or more of the problems set forth above.

SUMMARY OF THE INVENTION

In one aspect of the present invention, a shelf unit for a metallic locker is provided, including at least one set of legs, each leg set including at least three legs having a foot at their bottom and a head at their top, at least one of the legs being magnetic for attaching to the side wall of the metallic locker, and a first shelf lying horizontally in the metallic locker on top of the set of legs.

In one form of this aspect of the invention, a second set of legs and a second shelf are provided, wherein at least one of the legs of the second leg set is magnetic for attaching to the side wall of the metallic locker, the second leg set being stackable above the first shelf. In a further form, the feet of the second leg set include a longitudinally extending flange extending from the bottom of a laterally extending flange, and the first shelf includes at least three recesses adjacent a peripheral lip on the upper side of the first shelf, whereby the feet of the second leg set are disposed on the peripheral lip with the longitudinally extending flange extending to the bottom of the recess.

In a further form of this aspect of the invention, each leg set includes four legs.

In another form of this aspect of the invention, each leg of the leg set is magnetic for attaching to the side walls of the metallic locker.

In still another form of this aspect of the invention, the legs comprise a first material, and further include magnets secured at spaced positions along the length of the legs. In a further form, the first material is plastic.

In yet another form of this aspect of the invention, recesses are on the first shelf underside, and the leg heads are received in the recesses. In a further form, the legs include a column portion between their feet and head, the leg heads comprise laterally extending flanges at the upper end of the legs, and the recesses are open at the perimeter of the first shelf whereby the shelf may be supported at positions laterally spaced from the column portion.

In another aspect of the present invention, a kit is provided for making a shelf unit in a metallic locker, including at least one set of legs, each leg set including at least three legs having a column portion between a foot and a head, at least one of the legs being magnetic along the column portion, and a first shelf having an underside adapted to be supported on the heads of the legs when the column portions are substantially vertical.

In one form of this aspect of the present invention, a second set of legs and a second shelf are provided, wherein at least one of the legs of the second leg set is magnetic along its column portion. In a further form, the feet of the second leg set include a longitudinally extending flange extending from the bottom of a laterally extending flange, and the first shelf includes at least three recesses adjacent a peripheral lip on the upper side of the first shelf.

In a further form of this aspect of the invention, each leg set includes four legs.

In another form of this aspect of the invention, each leg of the leg set is magnetic along its column portion.

In still another form of this aspect of the invention, the legs comprise a first material, and further include magnets secured at spaced positions along the length of the legs. In a further form, the first material is plastic.

In yet another form of this aspect of the invention, recesses are on the first shelf underside sized to receive the leg heads. In a further form, the legs include laterally extending flanges at the upper end of the legs, and the underside recesses are open at the perimeter of the first shelf.

DETAILED DESCRIPTION OF THE INVENTION

Figure 1:
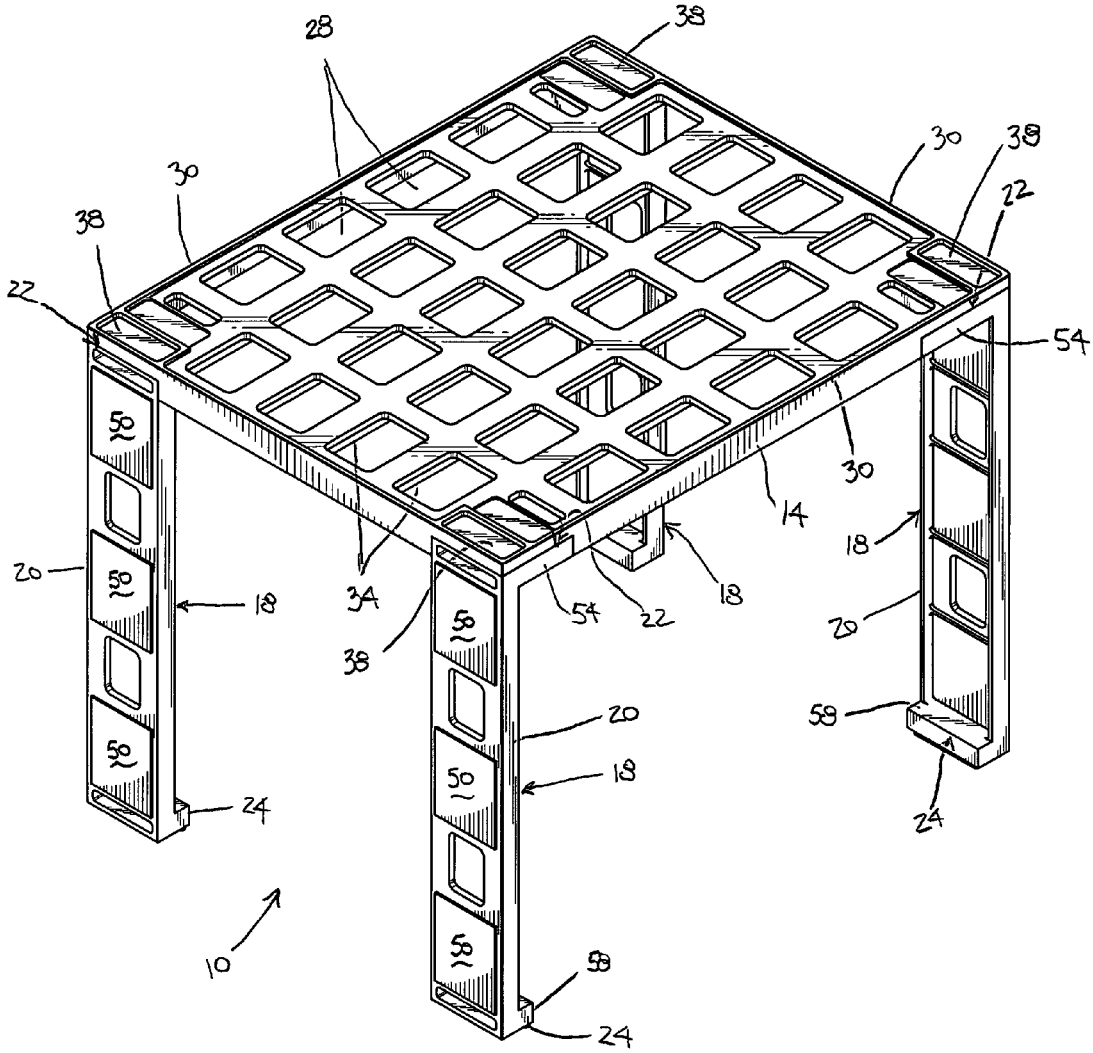
FIG. 1 is a perspective view of one shelf unit according to the present invention.
Figure 2:
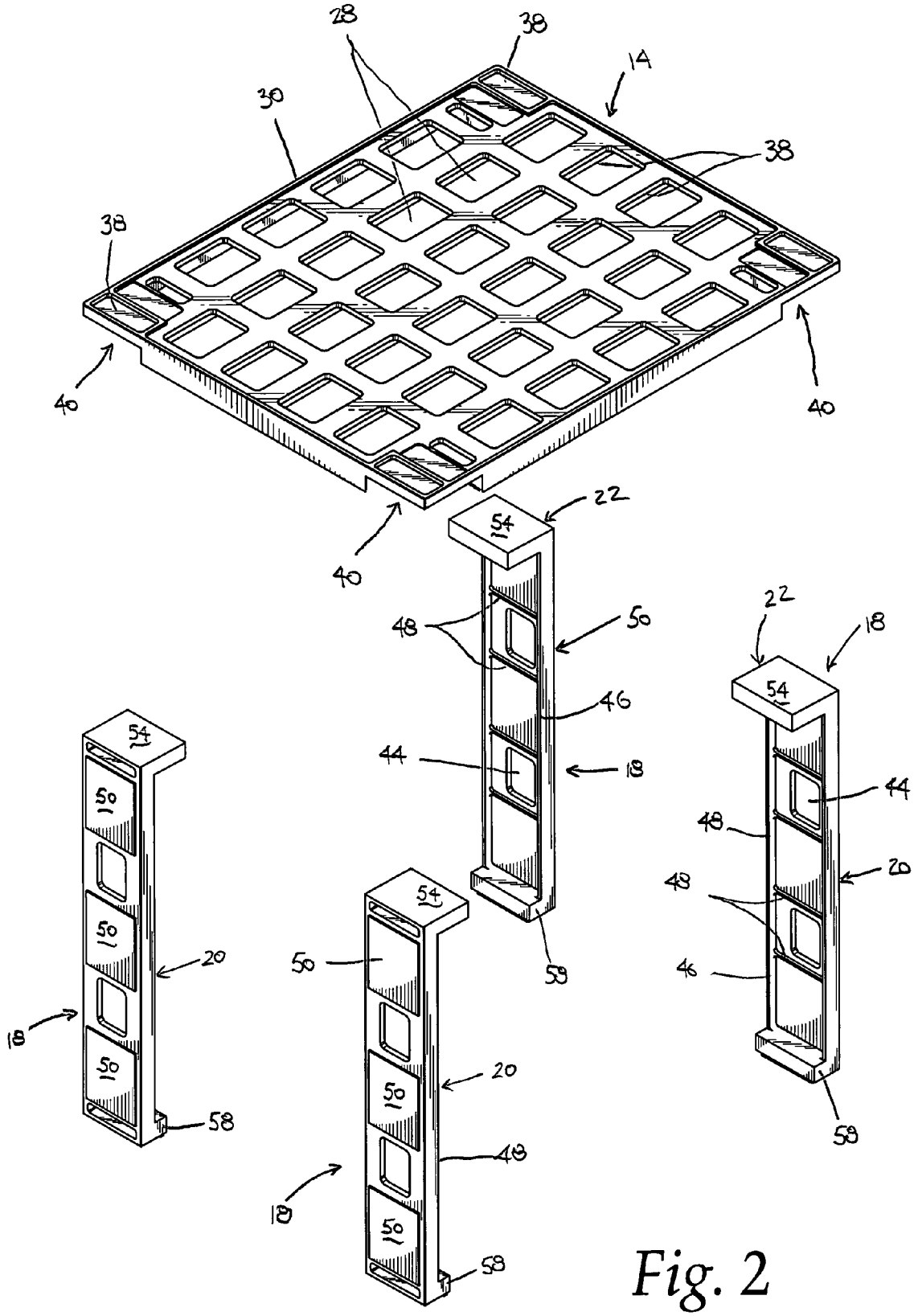
FIG. 2 is an exploded perspective view of the FIG. 1 shelf unit.

FIGS. 1–2 illustrate a shelf unit 10 according to the present invention. In the advantageous embodiment illustrated, the shelf unit 10 includes a shelf 14 and four legs 18. The legs 18 each include a column portion 20 having a head 22 on the upper end and a foot 24 on the lower end.

The shelf 14 includes openings 28 therethrough to allow dirt and the like to pass through without accumulating on the shelf 14, and also to allow the locker user to more easily see objects beneath the shelf 14. A lip 30 may also be provided around the perimeter of the shelf 14 to assist in maintaining items on the shelf 14 and to provide some reinforcement against bending of the shelf 14. A lattice of ribs 34 may also be provided on the underside of the shelf 14 to provide further rigidity against bending. Recesses 38 adjacent the corners beside the lip 30 are provided on the upper side of the shelf 14 for receiving the feet 24 of legs 18 stacked thereon in multi-shelf units as described in greater detail below. Recesses 40 are also provided in the underside at the corners of the shelf 14 for receiving the head 22 of the legs 18.

The leg column portion 20 is generally vertically oriented when in use. As illustrated, the column portions 20 include cutouts 44 (to reduce material requirements) and strengthening vertical ribs 46 on the edges and transverse reinforcing ribs 48.

In accordance with the present invention, the column portions 20 are magnetic along their height. In the illustrated embodiment, suitable magnets 50 are suitably secured along the height of the column portions 20. In the embodiment illustrated, flat rectangular magnets 50 are suitably secured (e.g., by adhesives) to the outer face of the column portions 20. Recesses may be provided in the outer face to facilitate the securing of the magnets 50 to the column portions 20.

As described in further detail hereafter, the provision of magnetic column portions 20 not only assists in easing assembly of the shelf unit 10, but it also provides reinforcement along the column portion height by securing them to the rigid walls of the locker. Such reinforcement allows even narrow, flimsy legs which have a good compressive strength to support large weights on the supported shelf, since the magnetic connection to the locker walls assists in ensuring that the column portions 20 will maintain a vertical orientation and not buckle or bend.

The heads 22 of the legs 18 as illustrated include laterally extending flanges 54. These flanges 54 are sized and shaped so that they may be received in the recesses 40 in the shelf 14. It should be appreciated, however, that the flanges 54 and the open-sided recesses 40 as illustrated will also provide flexibility in assembly for different size lockers. Specifically, if the locker is slightly wider than the shelf 14, the extension of the flanges 54 will provide support to the shelf 14 even though the shelf 14 does not reach fully to the locker wall. It should be appreciated that in such cases (in which the shelf 14 does not extend above the column portions 20), the weight of the shelf 14 and supported items may thus introduce a bending moment to the column portions 20, and that the magnets 50 advantageously serve as additional reinforcement against such bending.

The feet 24 of the legs 18 also include lateral flanges 58 having downwardly, longitudinally extending flanges 60 (see particularly FIG. 6) which are laterally spaced from the column portions 20. These feet 24 will provide a suitable base for the shelf unit 10, and further may be advantageously stacked on top of a shelf 14 in multi-shelf units 10 as described further below.

Figure 3:
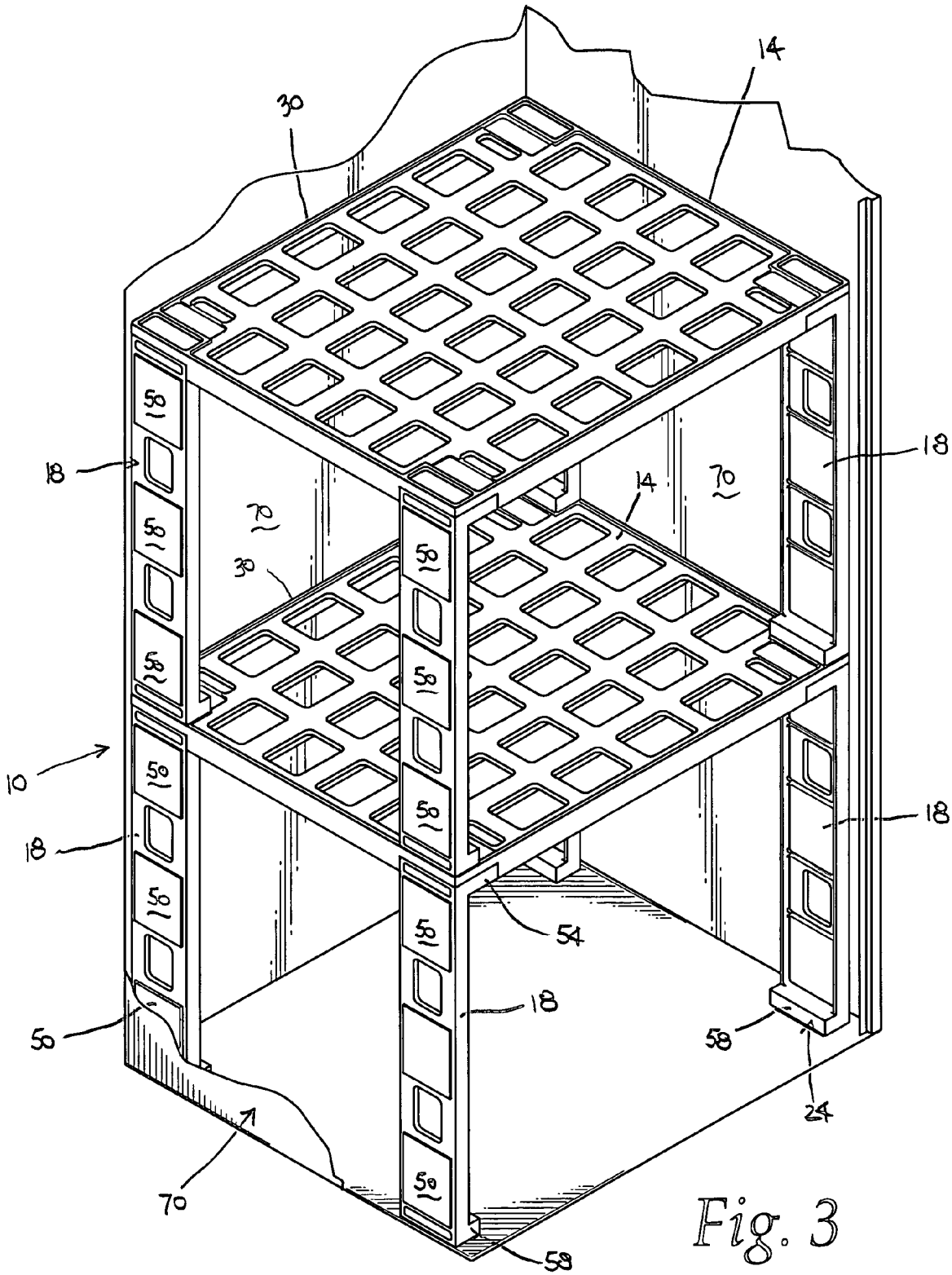
FIG. 3 is a perspective view of a two shelf unit according to the present invention assembled in a locker.

FIG. 3 illustrates two shelf units 10 such as illustrated in FIGS. 1–2 stacked on top of one another in a locker 70. This configuration may alternately be called two shelf units 10 or one two shelf unit 10'. Assembly of the unit 10 will be described here.

First, the bottom legs 18 may be generally positioned in the locker 70, with the legs being held in place by magnetic connection to the side walls of the locker 70. The bottom shelf 14 may then be moved into the locker 70 by first tipping the shelf 14 to fit through the narrower locker door opening, and then tipping the shelf 14 back to a horizontal orientation. The shelf 14 may then be lowered in that horizontal orientation to the top of the legs 18, and the legs 18 may be adjusted to ensure that their head 22 is received in the shelf underside recesses 40. It should be appreciated that as the shelf 14 is moved into the locker 70, the user will not be required to somehow simultaneously hold all four legs to maintain them in their desired position and orientation. Further, as each leg 18 is individually adjusted to shift it to the proper position beneath the shelf 14, there is no problem with the other legs 18 becoming disconnected or otherwise misoriented. That is, the shelf 14 may be readily placed on top of the legs 18 during assembly and each leg 18 suitably and individually adjusted to position it properly beneath the associated recesses 40. The assembly problem encountered with some prior units (in which the legs must be connected to the shelf within the confined space of the locker, with some legs being inadvertently disconnected when other legs are being connected) may thus be avoided.

Figure 5:
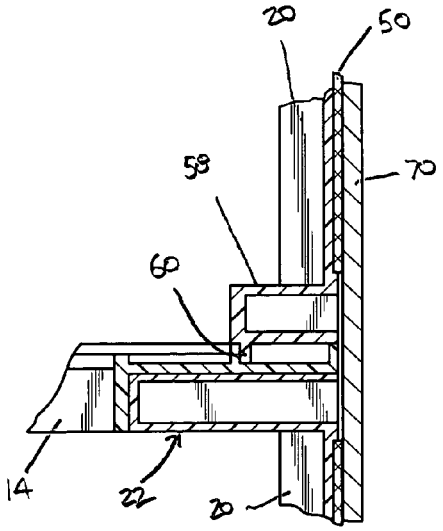
FIG. 5 is a detailed cross-sectional view showing stacked legs and a shelf assembled in a locker.
Figure 6:
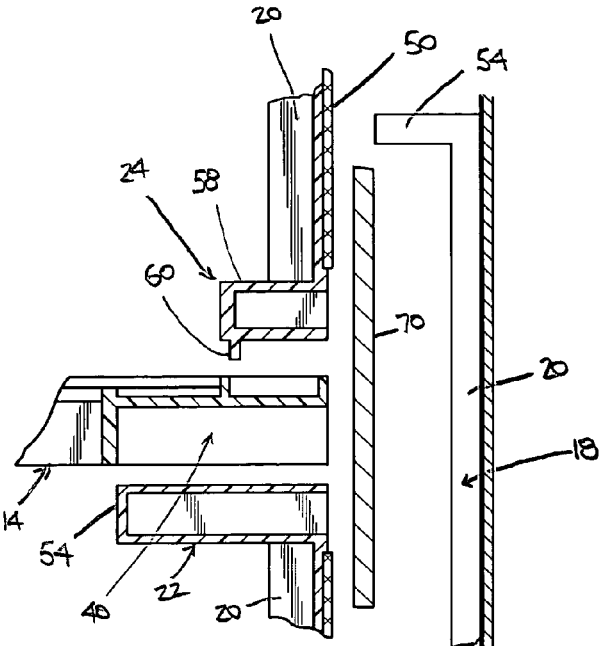
FIG. 6 is an exploded view of FIG. 5.
Figure 4:
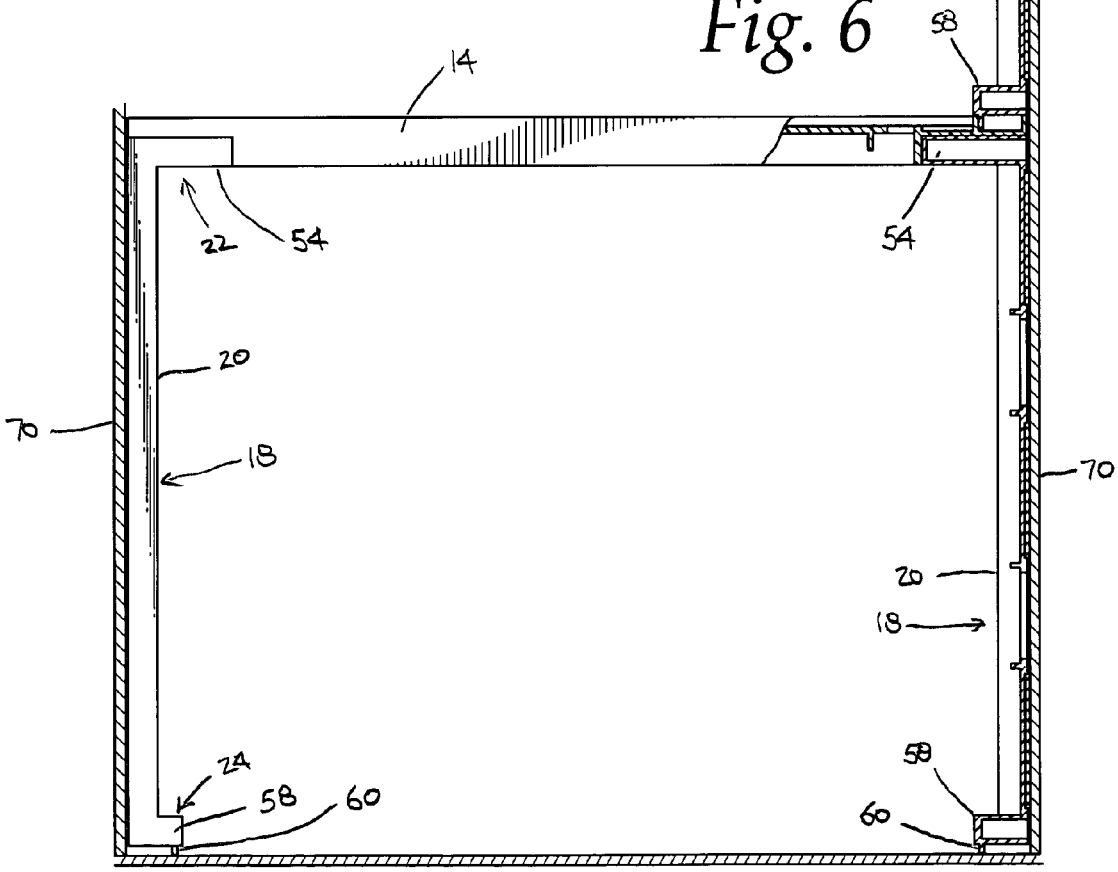
FIG. 4 is a partial cross-sectional view of the FIG. 3 unit.
Figure 1:
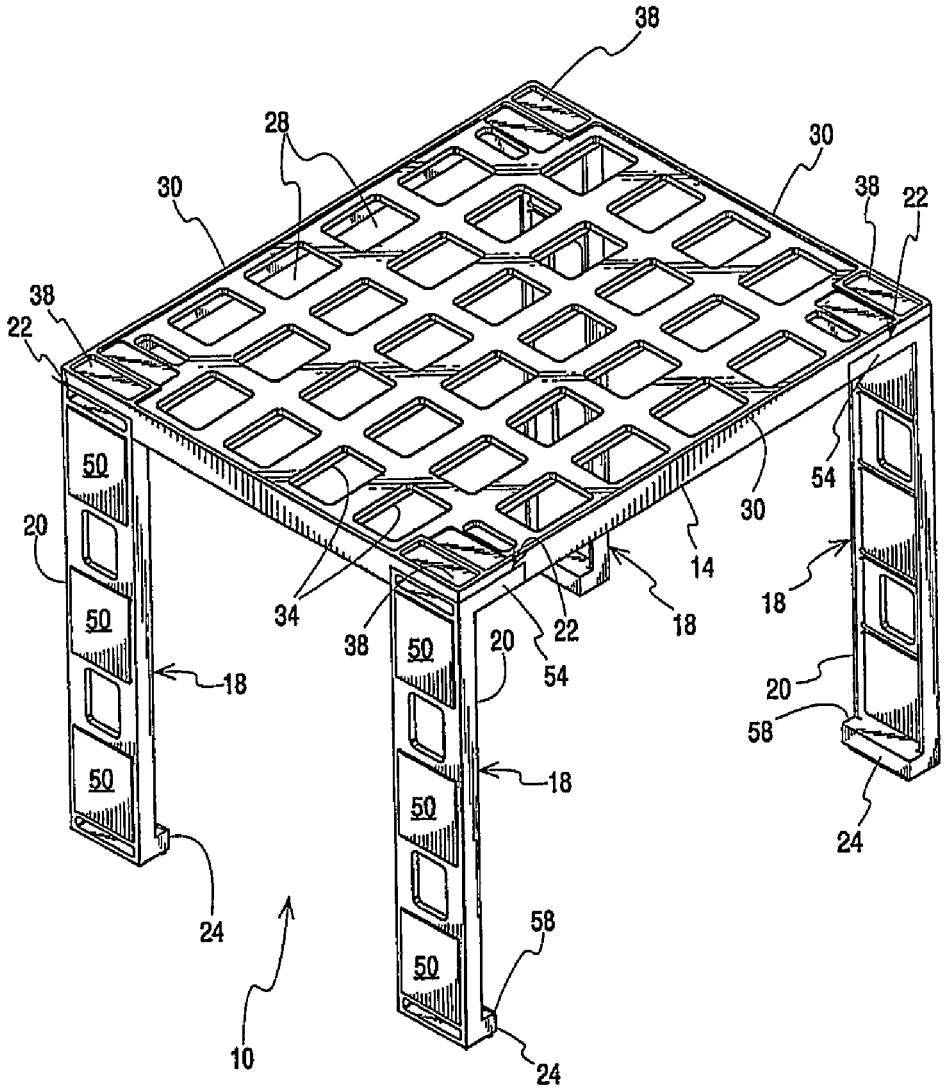
Figure 2:
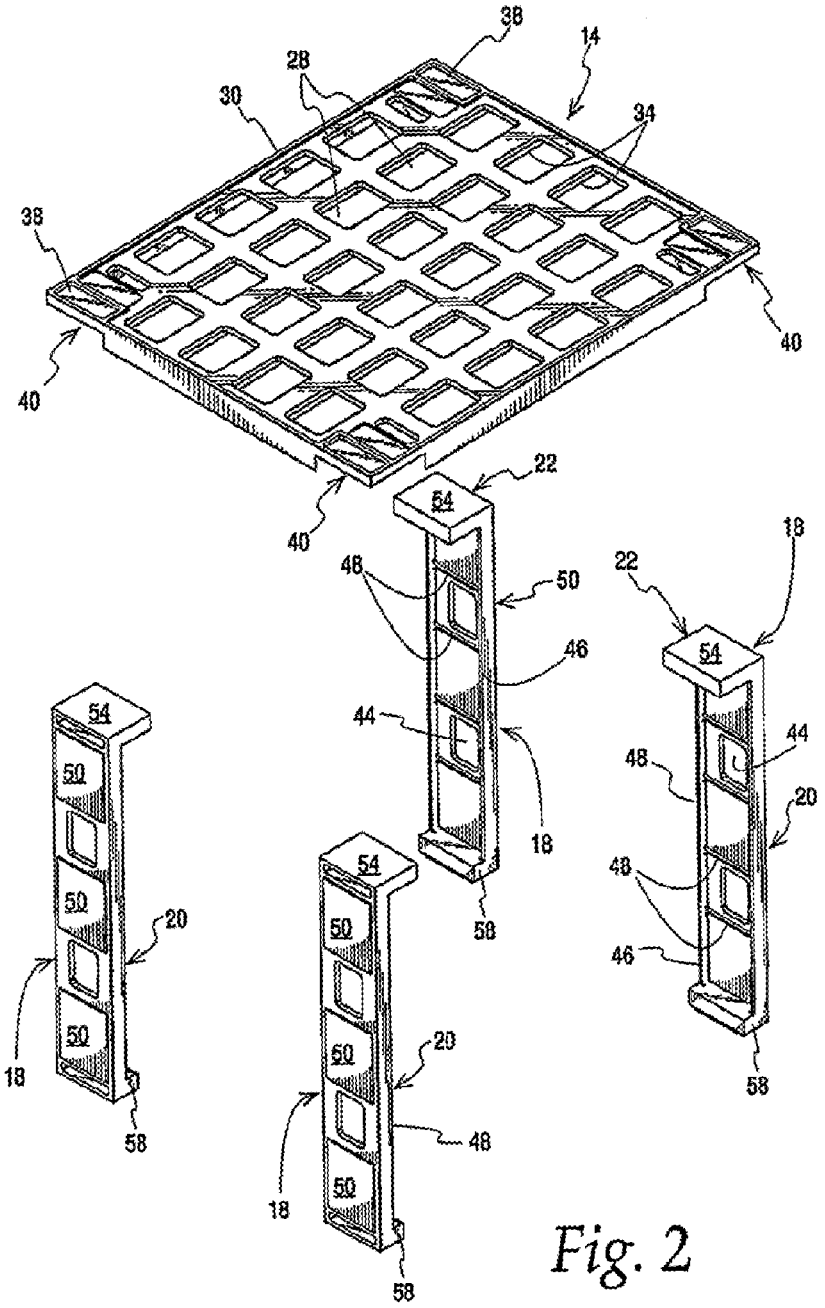
Figure 3:
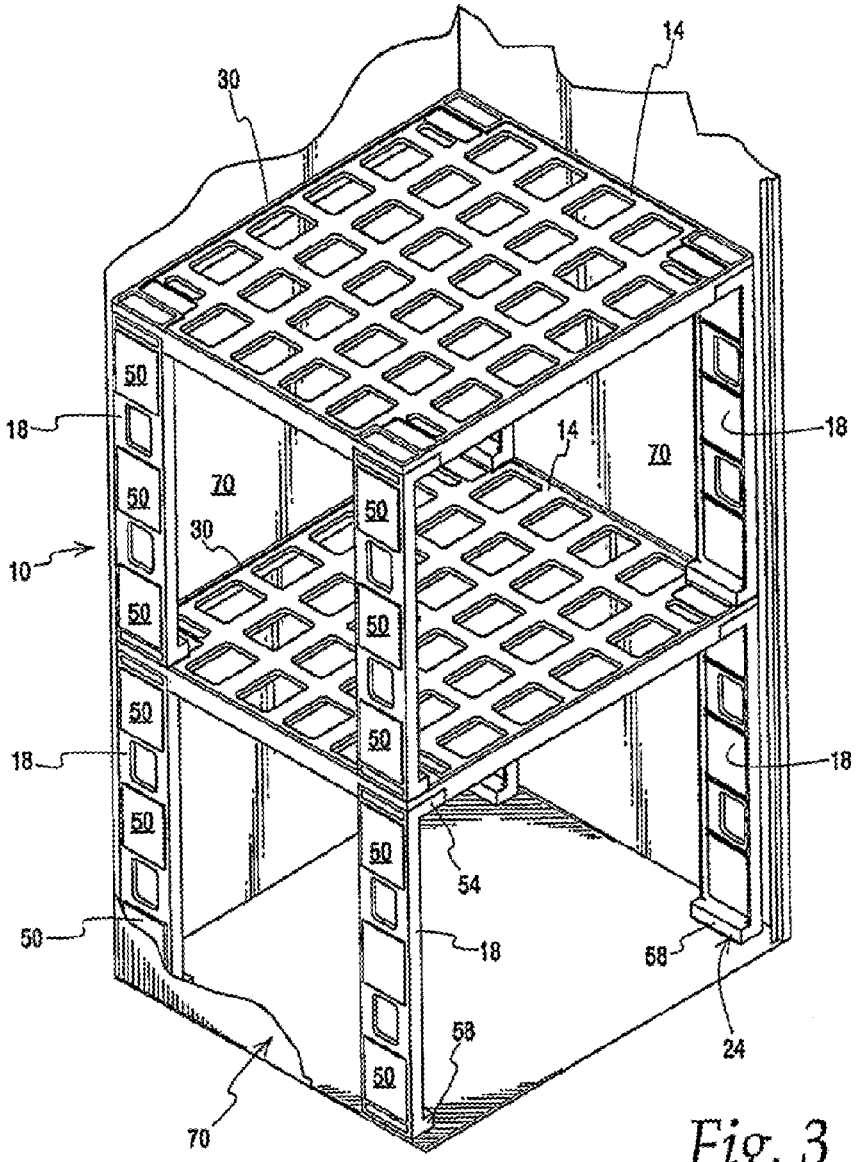
Figure 5:
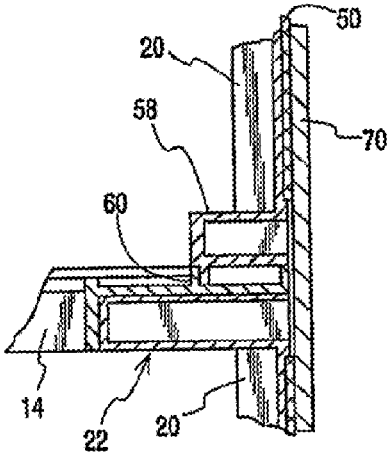
Figure 6:
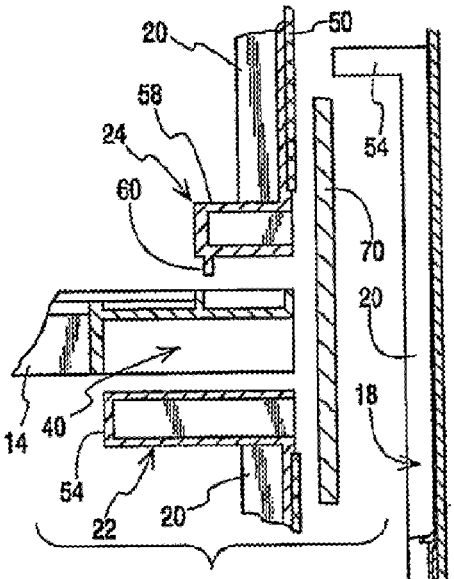
Figure 4:
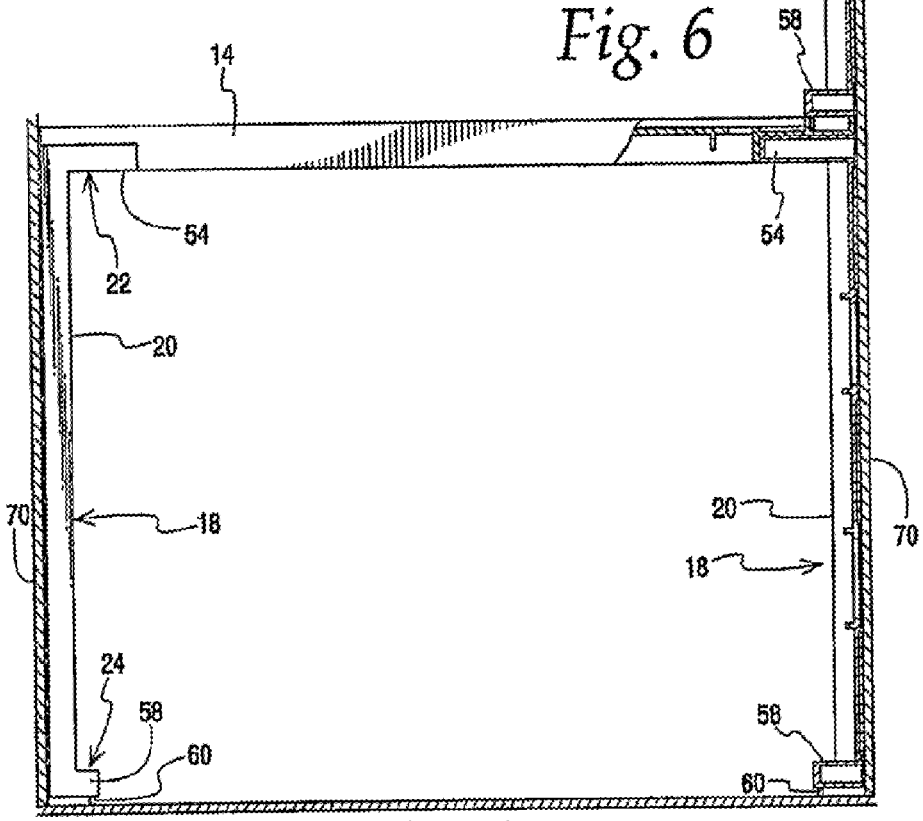

After the first (bottom) shelf 14 has been placed, another set of legs 18 are positioned above the shelf 14, with their feet 24 in the recesses 38 on the upper side of the first shelf 14. Specifically, as shown in FIGS. 5–6, the bottom of the leg column portions 20 rest on the lip 30 and each longitudinally extending flange 60 projects down into the associated recess 38 so as to rest on the bottom of the recess 38. (It should be understood that variations from perfect tolerances could result in the bottom of the column portion 20 or the longitudinally extending flange 60 of any leg 18 being slightly spaced from the shelf 14 rather than abutting to it. Nevertheless, normal shifting of components and distortion of the components will naturally result in abutment where such support is required.)

It should be appreciated that this connection of the upper legs 18 will allow for variances between locker size and shelf size. That is, if the shelf 14 is smaller than the locker, the upper legs 18 may still be magnetically connected to the locker walls, in which case the feet 24 of the legs 18 may not rest wholly over the shelf 14, and the longitudinally extending flange 60 will be positioned within the recess 38 but more closely to the shelf lip 30.

With the upper legs 18 supported in a vertical orientation by their magnetic connection to the walls of the locker 70, the second (upper) shelf 14 may then be placed on top of the legs 18 in the same manner as was the bottom shelf 14 as described above.

A kit may be advantageously provided consisting of one or more leg sets and shelves 14, whereby a person such as a student who has a locker may readily purchase and install the shelf unit 10 within the separate locker.

It should be appreciated that different shelf constructions than the one illustrated in the figures could be advantageously used with the present invention. For example, solid surface shelves could be used where it is desired to prevent any objects from falling through the shelves. Further, suitable adjustable size shelves (e.g., telescoping shelf components) could also be provided to permit ready use in different width lockers.

It should also be appreciated that the legs 18 of the shelf unit 10 of the present invention could be configured differently than shown, so long as the legs 18 are in some manner magnetically attracted to the walls of the locker. For example, more or fewer magnets 50 may be provided on the legs, and of different sizes than illustrated, while still maintaining at least some advantages of the present invention. In addition, magnet(s) 50 could be secured to the legs 18 differently than illustrated in the figures (e.g., by mechanical connection, integral formation with the leg, or by the entire leg itself being magnetic). Moreover, it should be appreciated that some aspects of the advantages of the present invention could be obtained if only a single leg 18 of a leg set is magnetic.

Further, it should be appreciated that the present invention may be used in shelf units having less or more than four legs, and with legs at other than the corners of the shelf so long as the legs are disposed adjacent the locker walls so that they may be magnetically attracted and secured thereto.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A shelf unit for a metallic locker comprising:

a first set of legs, each leg set including at least three legs having a foot at their bottom and a head at their top, at least one of said legs being magnetic for attaching to the side wall of a metallic locker;

a first shelf lying horizontally in the metallic locker on top of said first set of legs;

a second set of legs and a second shelf, wherein at least one of said legs of said second leg set is magnetic for attaching to the side wall of a metallic locker, said second leg set is magnetic for attaching to the side wall of metallic locker, said second leg set being stackable above said first shelf; and wherein said feet of said second leg set includes a longitudinally extending flange extending from the bottom of a laterally extending flange, and said fist shelf includes at least three recesses adjacent a peripheral lip on the upper side of said first shelf, whereby said feet of said second leg set are disposed on said peripheral lip with said longitudinally extending flange extending to the bottom of said recess.

2. The shelf unit of claim 1, wherein each leg set includes four legs.

3. The shelf unit of claim 1, wherein each leg of said leg set is magnetic for attaching to the side walls of the metallic locker.

4. The shelf unit of claim 1, wherein said legs comprise a first material, and further include magnets secured at spaced positions along the length of said legs.

5. The shelf unit of claim 4, wherein said first material is plastic.

* * * * *

UNITED STATES PATENT AND TRADEMARK OFFICE

CERTIFICATE OF CORRECTION

PATENT NO. : 6,971,529 B1
APPLICATION NO. : 10/999877
DATED : December 6, 2005
INVENTOR(S) : David Shapiro It is certified that error appears in the above-identified patent and that said Letters Patent is hereby corrected as shown below:

The title page showing the illustrative figure should be deleted to be replaced with the attached title page.

The drawings 1-6, consisting of Figs. 1-6, should be deleted to be replaced with drawing sheets consisting of Figs. 1-6, as shown on the attached page.

Column 6, starting with line 13, delete "said";

Column 6, delete line 14;

Column 6, line 15, delete "of metallic locker".

Signed and Sealed this

Eleventh Day of September, 2007

JON W. DUDAS
*Director of the United States Patent and Trademark Office*

(12) United States Patent
Shapiro

(10) Patent No.: US 6,971,529 B1
(45) Date of Patent: Dec. 6, 2005

(54) MAGNETIC SHELF UNIT FOR A LOCKER

(75) Inventor: David Shapiro, Chicago, IL (US)

(73) Assignee: It's Academic of Illinois, Inc., Northbrook, IL (US)

( * ) Notice: Subject to any disclaimer, the term of this patent is extended or adjusted under 35 U.S.C. 154(b) by 0 days.

(21) Appl. No.: 10/999,877

(22) Filed: Nov. 30, 2004

(51) Int. Cl.[7] ..... A47B 57/00
(52) U.S. Cl. ..... 211/188; 211/DIG. 1
(58) Field of Search ..... 211/188, DIG. 1, 211/189, 185, 126.12; 248/206.5, 309.4

(56) References Cited

U.S. PATENT DOCUMENTS 4,500,146 A * 2/1985 Peterson ..... 312/257.1
4,810,044 A * 4/1989 Dobry ..... 312/257.1
5,221,013 A * 6/1993 Santucci ..... 211/153
5,251,973 A * 10/1993 Hazan ..... 312/257.1
5,415,472 A * 5/1995 Brise ..... 312/257.1
5,421,546 A * 6/1995 McNamara et al. ..... 312/205
5,474,192 A * 12/1995 Hartzell ..... 211/90.04

* cited by examiner

*Primary Examiner*—Sarah Purol
(74) *Attorney, Agent, or Firm*—Wood, Phillips, Katz, Clark & Mortimer

(57) ABSTRACT

A shelf unit for a metallic locker including at least one set of legs, and a first shelf lying horizontally in the metallic locker on top of the set of legs. Each leg set includes at least three legs having a foot at their bottom and a head at their top, at least one of the legs being magnetic for attaching to the side wall of the metallic locker. A kit consisting of the components of the shelf unit is also provided.

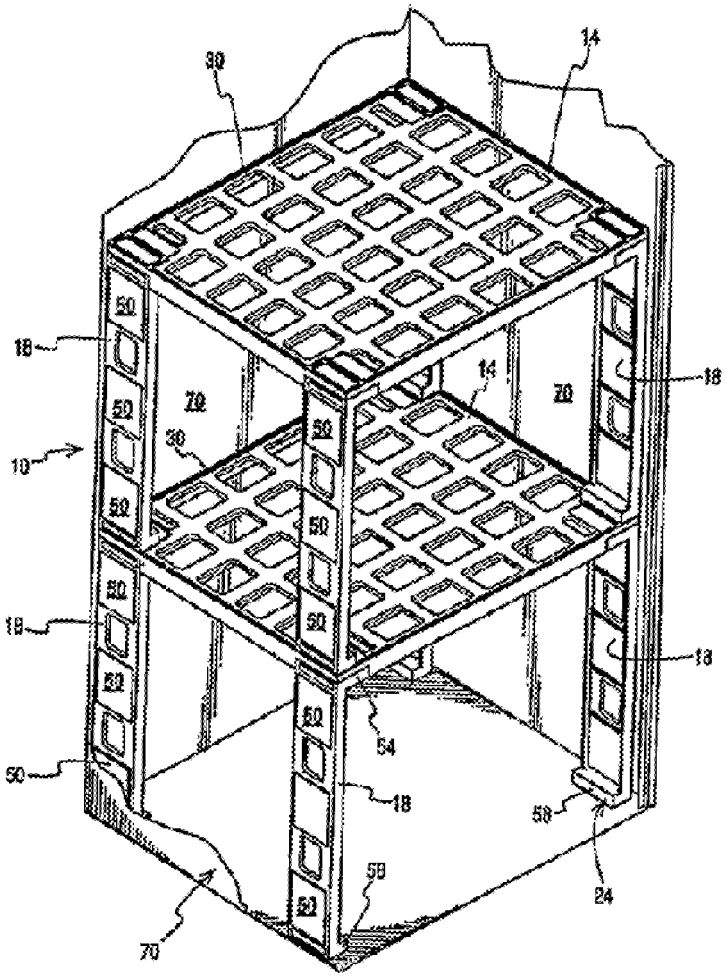

5 Claims, 4 Drawing Sheets